US005385365A

United States Patent [19]

Edmund

[11] Patent Number: 5,385,365

[45] Date of Patent: Jan. 31, 1995

[54] SAFETY SKI BINDING

[76] Inventor: James M. Edmund, 260 Pawnee Dr., Boulder, Colo. 80303

[21] Appl. No.: 61,266

[22] Filed: May 17, 1993

[51] Int. Cl.[6] ..... A63C 9/086

[52] U.S. Cl. ..... 280/627; 280/634

[58] Field of Search ..... 280/616, 627, 631, 632, 280/634, 624, 611

[56] References Cited

U.S. PATENT DOCUMENTS 2,705,150 3/1955 Hansen ..... 280/627
3,730,543 5/1973 Edmund ..... 280/611
3,955,825 5/1976 Kubelka et al. ..... 280/634 X
4,261,595 4/1981 Smialowski et al. ..... 280/627 X
4,624,473 11/1986 Knabel et al. ..... 280/632 X
4,948,159 8/1990 Jungkind ..... 280/632

*Primary Examiner*—Margaret A. Focarino
*Assistant Examiner*—Carla Mattix
*Attorney, Agent, or Firm*—Paul M. Craig, Jr.

[57] ABSTRACT

A safety ski binding in which the bottom of the ski boot is held out of contact with the top of the ski to eliminate the influence of frictional forces on the safety release and in which the anti-friction roller of the toe support structure is mounted on the ski in such a manner that its vertical axis of rotation remains substantially constant during engagement and disengagement.

20 Claims, 3 Drawing Sheets

SAFETY SKI BINDING

FIELD OF INVENTION

This invention relates to a safety release-type step-in ski binding in which the bottom of the ski boot is held out of contact with the top of the ski to eliminate the influence of frictional forces on the safety release action of the ski binding.

BACKGROUND OF THE INVENTION

The importance of minimizing the influence of frictional forces on the safety release of a safety release ski binding are explained in my prior U.S. Pat. No. 3,730,543, the contents of which are incorporated herein by reference. As explained in my prior patent, the two functions of (a) clamping the ski boot firmly to the ski during normal maneuver and (b) the release of the clamping action to permit the boot to disengage from the ski to save the leg from injury are only incompletely realized with prior art safety bindings in which the boot sole rests on the ski. To minimize the influence of the frictional forces on the safety release, my aforementioned patent disclosed a step-in safety binding with toe and heel units so constructed that the bottom of the ski boot is kept out of contact with the surface of the ski.

SUMMARY OF THE INVENTION

The safety ski binding of this invention, somewhat similar to the safety ski binding of my aforementioned U.S. patent, utilizes a cam member attached to the toe of the boot which engages in and is supported by an hourglass-shaped roller member while the ski boot heel is supported by a heel cam structure. However, the ski binding of this invention offers a number of significant advantages over the ski binding of my prior aforementioned patent while at the same time retaining the substantial advantages over commercially available safety ski bindings. More specifically, the toe unit of this invention is simpler and functionally more reliable than that of my aforementioned patent and the heel unit provides better lateral rigidity with consequent better ski edging than with the ski binding of my aforementioned patent.

These advantages are attained according to the present invention by an improved toe unit construction which utilizes a parallelogram linkage to support the hourglass-shaped roller so that its motion is restricted to a fore-and-aft direction rather than a slidable crosshead motion, as in my aforementioned patent. The bearings of the links of the parallelogram linkage of this invention are much less vulnerable to erosive wear than are the cross head and its supporting bore of my aforementioned patent due to the relative smaller motion. Greater ease of step-in engagement is achieved according to the present invention in that the structural part to which the hourglass-shaped roller is rotatably secured, maintains the same angle relative to the vertical during its fore-and-aft motion. As a result thereof, during step-in engagement, the toe cam member of the boot slides down the corresponding structural part formed by a link member of the parallelogram linkage into engagement with the hourglass-shaped roller at a nearly constant angle, causing step-in engagement to be easy and reliable. By contrast, the lever of my prior patent which guides the boot toe cam member during step-in engagement in the safety ski binding of this patent, changes its angle relative to the vertical by as much as 45° during the engagement. This made it frequently necessary for the user to lean over and press the lever by hand to secure engagement.

Additionally, the heel cam member secured to the boot in my prior patent wedges between the roller 175 and the cross member 174, secured to the ski. Any lateral rocking of the boot relative to the ski is resisted in my prior patent by the rigidity of the cross piece 163 and the rigidity of the interface between legs 161 and 162 with respect to the boot sole. As the legs 161 and 162 are less than 1¾" apart, a slight elastic deflection of the polyurethane boot sole material can result in a significant rocking deflection of the boot relative to the ski. This disadvantage is obviated by the present invention in that a pair of rollers approximately 2½" apart engage with the cam portions that are bolted to the sides of the boot heel. The bolts, used for that purpose, which extend completely through the width of the boot heel, provide a much firmer support to the heel cam members than was possible in the safety binding of my prior patent. Furthermore, the greater distance between the two heel cam members improves the lateral rocking rigidity.

BRIEF DESCRIPTION OF THE DRAWING

These and other objects, features and advantages of the present invention will become more apparent from the following description when taken in connection with the accompanying drawing, which shows, for purposes of illustration only, one embodiment in accordance with the present invention and wherein.

DETAILED DESCRIPTION OF THE DRAWINGS

Figure 2:
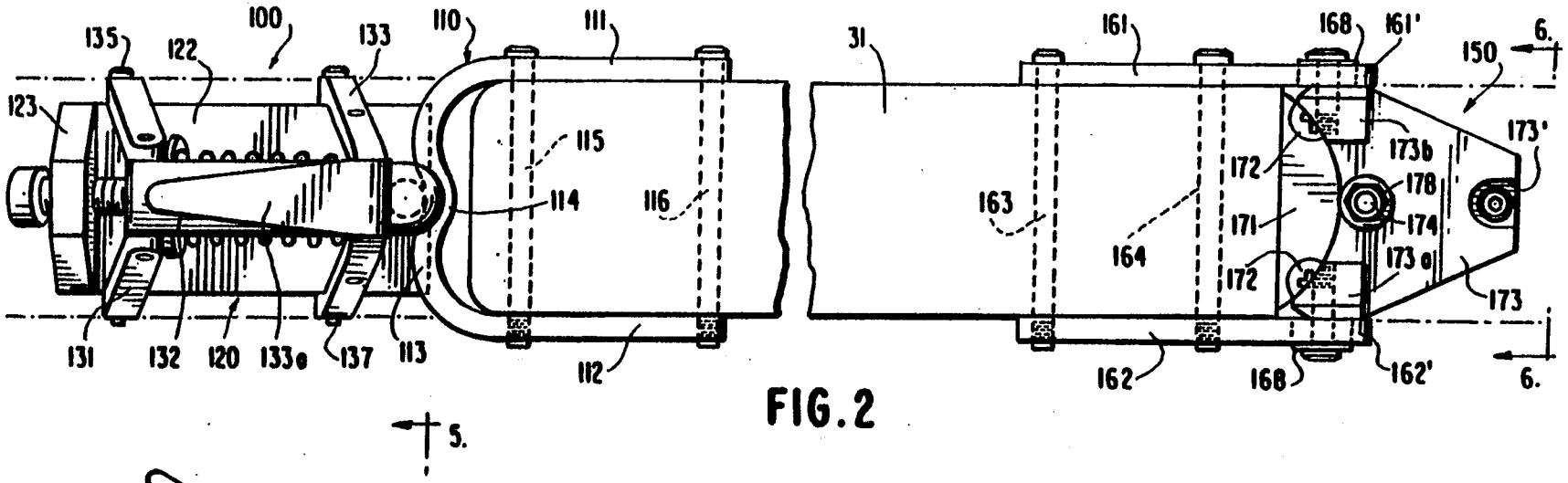
FIG. 2 is a top plan view on the ski binding of FIG. 1, with the ski omitted for sake of clarity and showing only the sole of a ski boot.
Figure 1:
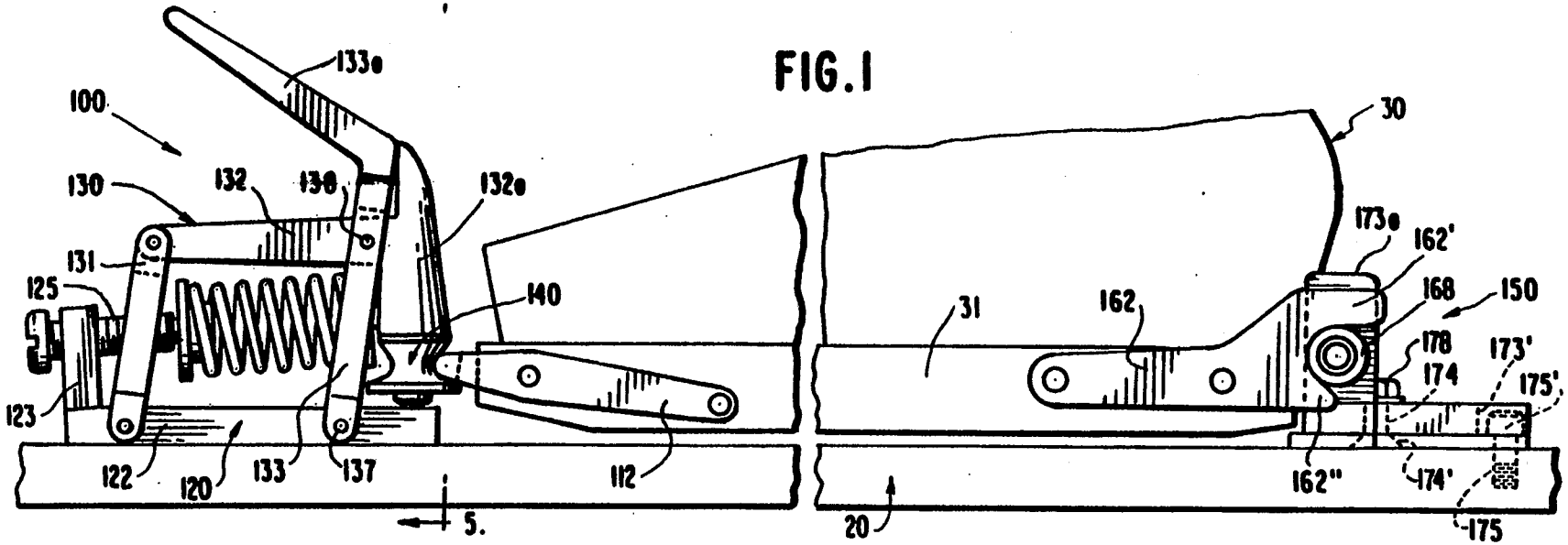
FIG. 1 is a side elevational view of a safety ski binding in accordance with the present invention with a ski boot in the safety ski binding on the ski.
Figure 4:
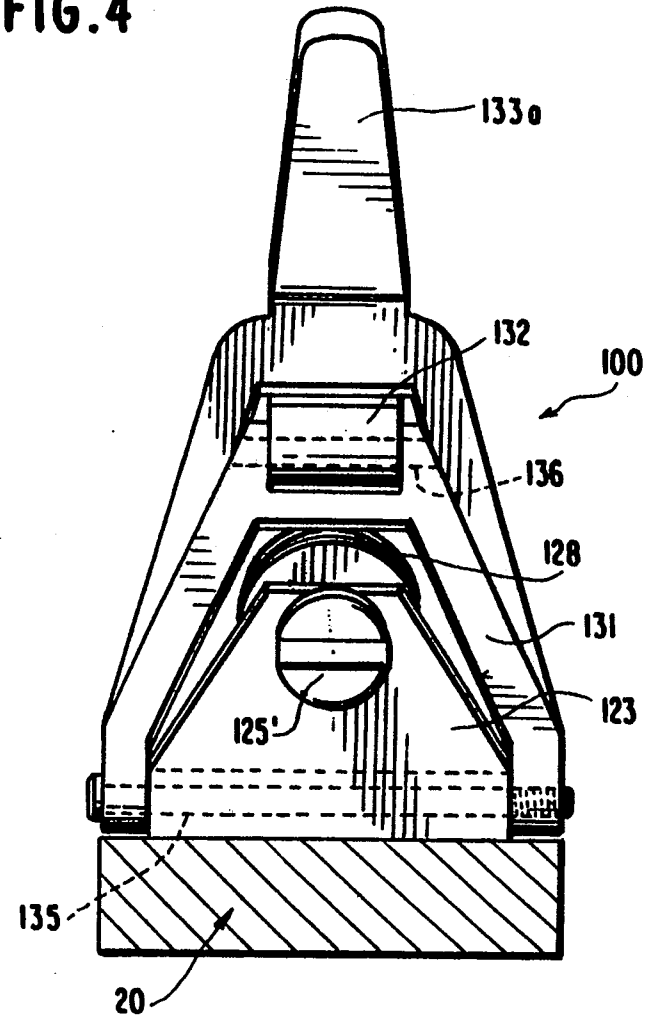
FIG. 4 is a front elevational view of the toe unit of the safety ski binding in accordance with the present invention.
Figure 3:
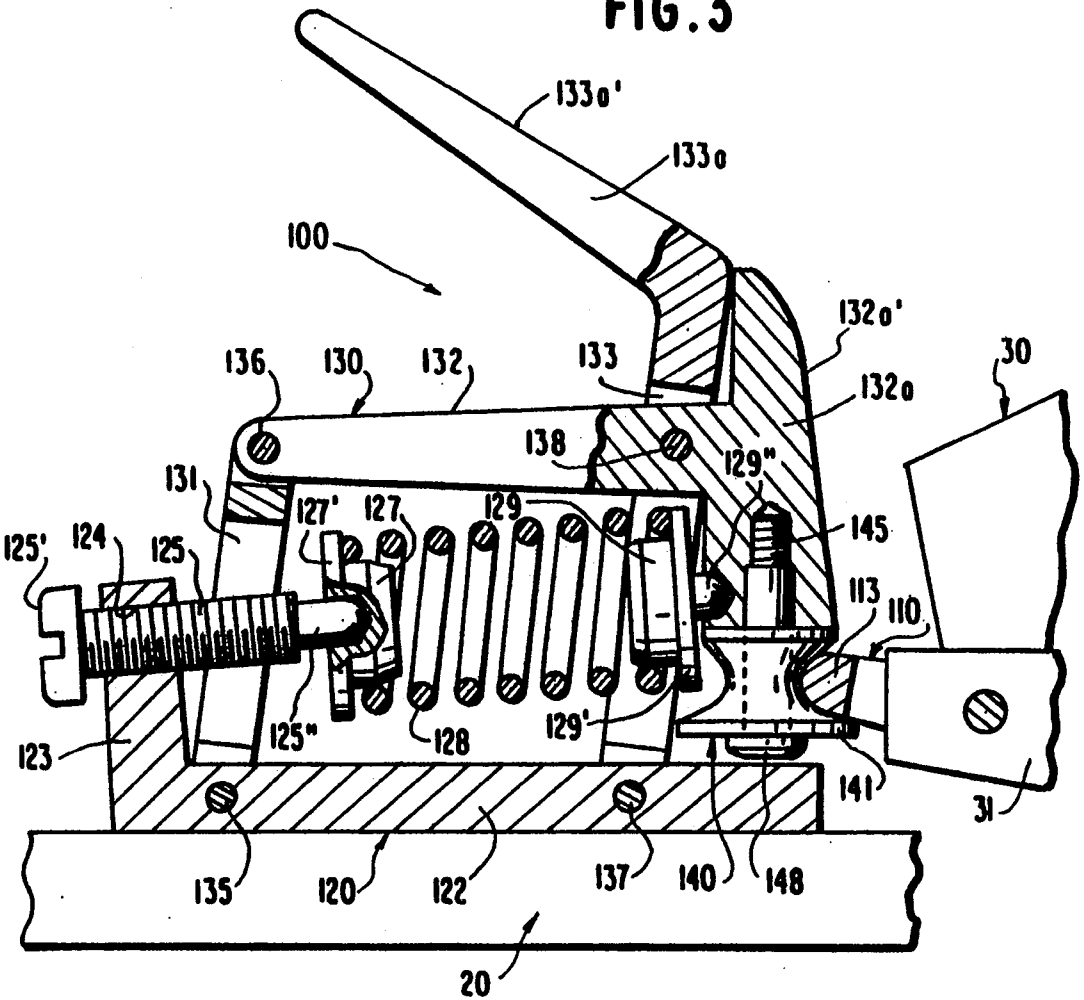
FIG. 3 is a side elevational view, on an enlarged scale, of the toe unit of the safety binding in accordance with the present invention, illustrating some of the parts thereof broken away.
Figure 6:
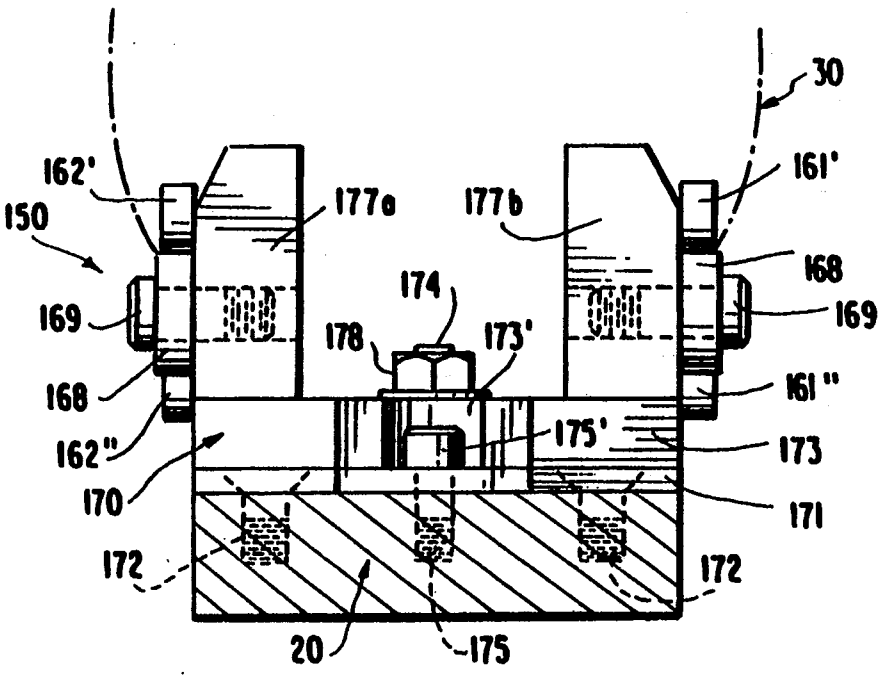
FIG. 6 is a cross-sectional view, taken along line 6—6 of FIG. 2.
Figure 5:
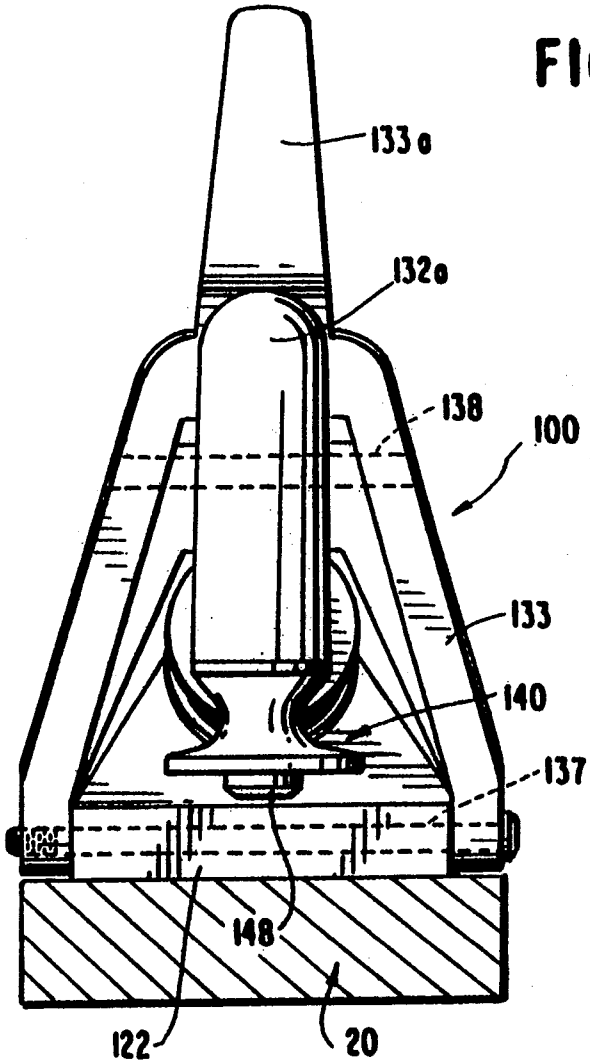
FIG. 5 is a cross-sectional view, taken along line 5—5 of FIG. 1.

Referring now to the drawing, wherein like reference numerals are used throughout the various views to designate like parts, and more particularly to FIG. 1, reference numeral 20 generally designates a ski, shown only partially, onto which is clamped a boot generally designated by reference numeral 30 which includes a boot sole 31. The safety ski binding of this invention consists of a toe unit generally designated by reference numeral 100 and of a heel unit generally designated by reference numeral 150. The toe unit 100 includes a toe lug member generally designated by reference numeral 110 which consists of an essentially U-shaped piece of steel rod bent into the shape shown in FIG. 2, i.e., having leg portions 111 and 112 connected by a cross cam member 113 having a central depression 114. The two leg portions 111 and 112 are rigidly secured to the boot sole 31 by connecting members 115 and 116 which extend through the entire width of the boot sole 31 and may be of any conventional construction. The ski-mounted toe support structure generally designated by reference numeral 120 includes a base member 122 having a forward, upwardly inclined end portion 123 extending at an angle which differs slightly from a 90° angle. The end portion 123 is provided with an internal threaded bore 124 (FIG. 3) to receive a spring pressure-adjusting screw 125 having a screw head portion 125' and a non-threaded shank portion 125" which extends with its rounded-off spherical end portion in a recess of complementary shape in the spring-support member 127 provided with an annular spring abutment collar or flange 127' as shown in FIG. 3. The compression coil spring 128 abuts at its forward end at the annular spring abutment collar 127' and at its rear end at the annular spring abutment collar 129' of the spring retaining member 129. The spring retaining member 129 is provided on its rear side with a shank portion 129" which is again rounded off substantially spherically shaped to engage in a complementary recess of the vertical member **132*a***, as will be explained more fully hereinafter.

The parallelogram linkage generally designated by reference numeral 130 (FIG. 3) includes a first forward linkage member 131 pivotally secured to the base member 122 by the pivotal connection 135 and pivotally connected to the second longitudinally extending linkage member 132 by way of a pivotal connection 136. The second linkage member 132, in turn, is pivotally connected with a third rear upwardly extending linkage member 133 by way of pivotal connection 138 while the third linkage member 133 is pivotally connected to the base member 122 by way of pivotal connection 137. The parallelogram linkage is thus constituted by the base member 122 fixedly secured to the ski and the three linkage members 131, 132 and 133 as well as their pivotal connections 135, 136, 137 and 138 so that the longitudinally extending linkage member 132 can only move in a direction parallel to the base member 122. This means that the upwardly extending support piece **132*a* integral with the rear end of the second linkage member 132 will essentially retain always its angle with respect to the vertical position. This in turn means that the axis of the roller member generally designated by reference numeral 140 which is secured to the vertical support member 132*a* by way of a threaded bolt 148 or the like will also retain substantially the same angle with respect to the vertical. The roller member 140 is of approximately hourglass-like shape with a relatively wider lower flange portion 141 to prevent the cam portion 113 from slipping below the same during engagement of the boot. The lever 133*a* which extends forwardly at an incline is thereby integral with the third linkage member 133 so that pressure applied on the lever 133*a* will cause the parallelogram linkage to move forwardly whereby the roller 140 can be moved out of engagement with the cam portion 113 to permit release of the ski boot. The release force necessary to release the safety toe unit can be adjusted by means of the adjusting screw 125 which causes adjustment of the compression of the spring 128 which transmits the compressive forces to the upright structural vertical support part 132*a* by way of the shank portion 129". The inclined surface 132*a'* of the vertical support part 132*a* helps to guide the cam portion 113 into engagement with the roller 140** during step-in engagement of the boot.

The heel unit of the safety binding of this invention, generally designated by reference numeral 150, includes a ski-mounted heel support structure generally designated by reference numeral 170 which includes a sub-base member 171 secured to the ski top surface by way of screws 172. The base member 173 is pivotally secured to the sub-base member 171 for limited pivotal movement by way of screw 174 and nut 178. The screw head 174' of screw 174 is thereby accommodated in a countersunk bore provided in the sub-base member 171 (FIG. 1). In addition to screws 172, the sub-base member 171 is secured to the ski 120 by way of a screw or bolt 175 accommodated within a recess 173' in base member 173 and of larger width than the screw or bolt head 175' so that the base member 173 has limited pivotal movement relative to the sub-base member 171. Heel lug members 161 and 162 are secured to the sides of the boot heel by means of connections 163 and 164 which extend through the entire boot heel for rigidity and may be of any conventional type. The rear end portions of heel lug members 161 and 162 terminate in cam portions 161' and 161" as well as in cam portions 162' and 162" which engage with lateral rollers 168 rotatably mounted on upright support pieces **173*a* and 173*b* fixed relative to the base member 171**, for example, integral therewith.

In operation, the skier will first cause the heel of the boot to engage with the heel unit by causing the cam members 161', 161" and 162', 162" to engage with rollers 168. Once engagement is realized, the skier will then cause engagement of the ski boot with the toe unit by pivoting the toe portion of the ski boot downwardly, causing compression of the coil spring 128 until the cross central depression 114 of the cam portion 113 engages with roller 140. Release of the safety ski binding is possible by applying downward pressure on the lever **133*a* which causes the roller 140 to move in the forward direction, guided by the parallelogram linkage 130** so as to permit disengagement from the toe unit.

The safety ski binding of this invention offers several significant advantages. The use of the parallelogram linkage permits appropriate selection of the angle of the surface **132*a'* of the vertical support part 132 because the angle thereof with respect to the vertical remains substantially constant. During step-in engagement, the cross cam portion 113 therefore slides down the surface 132*a'* into engagement with the hourglass-shaped roller 140, thereby facilitating step-in engagement because of the constant angle. Additionally, corrosive wear is reduced with the use of the parallelogram linkage 130. Furthermore, lateral rocking of the boot 30 relative to the ski 20 is resisted by the greatly increased support obtained with the heel unit 150 of this invention in which the pair of rollers 168 are spaced laterally at the greater distance of about two and one-half inches and the bolts 163 and 164 extend completely through the width of the heel, thereby providing firmer support to the heel cam portions 161' and 162'** and improving lateral rocking resistance. By the use of a sub-base member screwed to the ski on which the base member carrying the roller members is rotatably secured for limited pivotal movement having a vertical pivot axis at right angle to the ski surface, both rear cam members will firmly engage their respective rollers with no lost motion. Additionally, the pivotal motion limitation is desirable for easy engagement of the boot with the ski.

While I have shown and described only one embodiment in accordance with the present invention, it is understood that the same is not limited thereto but is susceptible of numerous changes and modifications as known to those skilled in the art. For example, the toe and heel cam members bolted to the boot sole may be incorporated instead on a rigid plate on which the boot rests, strapped to the boot in a conventional manner. Such modified construction would be, in some respects, more conventional but would sacrifice some of the highly desirable lateral rigidity. Moreover, various other modifications suggested in my aforementioned U.S. patent may also be incorporated in the present invention. I therefore do not wish to be limited to the details shown and described herein but intend to cover all such changes and modifications as are encompassed by the scope of the appended claims.

I claim:

1. A safety ski binding for a ski in which the sole of a ski boot is held out of contact with the ski surface, comprising a toe structure and a heel structure, means releasably retaining the ski boot in the toe structure and in the heel structure in such a manner that at least the entire forward portion of the underside of the sole of the ski boot is spaced from the surface of the ski including toe and heel lug means projecting, respectively, forwardly and rearwardly from the boot sole, and toe and heel support means on the ski each including anti-friction roller means supported thereon for engagement with the respective lug means to provide a suspension of the ski boot from said surface, one of said support means including spring means for spring-loading the binding to normally clamp the boot to the ski while enabling release in case of a predetermined force, and the toe support means including a support part for the anti-friction means and linkage means operable to keep the support part at a substantially constant angle.

2. A safety ski binding according to claim 1, wherein said linkage means is a parallelogram linkage.

3. A safety ski binding according to claim 2, wherein said parallelogram linkage includes a first forward linkage member pivotally secured relative to the ski, a second substantially longitudinally extending linkage member pivotally secured to the first linkage member, a third upwardly extending rear linkage member pivotally secured relative to the ski and pivotally connected with the second linkage member, said second linkage member also providing a substantially vertical support for the anti-friction roller means of the toe structure.

4. A safety ski binding according to claim 3, wherein said second linkage member is integral with the substantially vertically extending support part on which the corresponding anti-friction roller means is rotatably supported so that the support part retains substantially the same angle during movement of the parallelogram linkage.

5. A safety ski binding according to claim 4, wherein a release lever is fixed relative to said third linkage member.

6. A safety ski binding according to claim 5, wherein said support part has a guide surface along its rear end for guiding the toe lug means into engagement with the toe anti-friction roller means during engagement.

7. A safety ski binding according to claim 6, wherein the heel structure includes two heel lug members laterally supported to the ski boot heel which rearwardly thereof terminate in cam means operable to engage with two anti-friction roller means rotatably supported relative to the ski.

8. A safety ski binding according to claim 7, wherein said lateral heel lug members are secured to the boot heel by connecting means extending across the entire boot heel so as to improve lateral rigidity.

9. A safety ski binding according to claim 8, wherein said heel support means includes a sub-base member fixedly mounted to the top of the ski and a base member mounted on said sub-base member with limited pivotal movement.

10. A safety ski binding according to claim 3, wherein a release lever is fixed relative to said third linkage member.

11. A safety ski binding according to claim 4, wherein said support part has a guide surface along its rear end for guiding the toe lug means into engagement with the toe anti-friction roller means during engagement.

12. A safety ski binding according to claim 1, wherein the heel structure includes two heel lug members laterally supported to the ski boot heel which rearwardly thereof terminate in cam means operable to engage with two anti-friction roller means rotatably supported relative to the ski.

13. A safety ski binding according to claim 12, wherein said lateral heel lug members are secured to the boot heel by connecting means extending across the entire boot heel so as to improve lateral rigidity.

14. A safety ski binding according to claim 1, wherein said heel support means includes a sub-base member fixedly mounted to the top of the ski and a base member mounted on said sub-base member with limited pivotal movement.

15. A safety ski binding for a ski in which the sole of a ski boot is held out of contact with the ski surface, comprising a toe structure and a heel structure, means releasably retaining the ski boot in the toe structure and in the heel structure in such a manner that at least the entire forward portion of the underside of the sole of the ski boot is spaced from the surface of the ski including toe and heel lug means projecting, respectively, forwardly and rearwardly from the boot sole, and toe and heel support means on the ski each including anti-friction roller means for engagement with the respective lug means to provide a suspension of the ski boot from said surface, one of said support means including spring means for spring-loading the binding to normally clamp the boot to the ski while enabling release in case of a predetermined force, and the heel structure including two heel lug members laterally supported to the ski boot heel which rearwardly thereof terminate in cam means operable to engage with two anti-friction roller means rotatably supported relative to the ski.

16. A safety ski binding according to claim 15, wherein said lateral heel lug members are secured to the boot heel by connecting means extending across the entire boot heel so as to improve lateral rigidity.

17. A safety ski binding according to claim 15, wherein said heel support means includes a sub-base member fixedly mounted to the top of the ski and a base member mounted on said sub-base member with limited pivotal movement.

18. A safety ski binding according to claim 15, wherein the toe support means includes parallelogram linkage means with a first forward linkage member pivotally secured relative to the ski, a second substantially longitudinally extending linkage member pivotally secured to the first linkage member, a third upwardly extending rear linkage member pivotally secured relative to the ski and pivotally connected with the second linkage member, said second linkage member also providing a substantially vertical support for the anti-friction roller means of the toe structure.

19. A safety ski binding according to claim 18, wherein said second linkage member is integral with a substantially vertically extending support part to which the corresponding anti-friction roller means is rotatably supported so that the support part retains substantially the same angle during movement of the parallelogram linkage.

20. A safety ski binding according to claim 19, wherein a release lever is fixed relative to said third linkage member.

* * * * *